US011608754B2

(12) United States Patent
Chong et al.

(10) Patent No.: US 11,608,754 B2
(45) Date of Patent: Mar. 21, 2023

(54) TURBINE NOZZLE ASSEMBLY AND GAS TURBINE INCLUDING THE SAME

(71) Applicant: DOOSAN ENERBILITY CO., LTD, Changwon (KR)

(72) Inventors: Gene Chong, Jupiter, FL (US); YeJee Kim, Changwon (KR); Darryl Eng, Stuart, FL (US); David Day, Jupiter, FL (US); Younggi Mun, Changwon (KR); Bryan Bernier, Jupiter, FL (US); Hongseung Seo, Changwon (KR); JaeBin Lee, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/375,595

(22) Filed: Jul. 14, 2021

(65) Prior Publication Data

US 2023/0017328 A1 Jan. 19, 2023

(51) Int. Cl.
*F01D 25/12* (2006.01)

(52) U.S. Cl.
CPC ..... *F01D 25/12* (2013.01); *F05D 2220/32* (2013.01); *F05D 2240/128* (2013.01); *F05D 2260/201* (2013.01)

(58) Field of Classification Search
CPC ..... F01D 25/12; F05D 2220/32; F05D 2240/128; F05D 2260/201
See application file for complete search history.

(56) References Cited

U.S. PATENT DOCUMENTS

| | | | | |
|---|---|---|---|---|
| 6,382,908 | B1 | 5/2002 | Keith | |
| 6,887,033 | B1 | 5/2005 | Phillips | |
| 7,029,228 | B2 | 4/2006 | Chan | |
| 7,195,454 | B2 | 3/2007 | Lu | |
| 8,038,389 | B2 | 10/2011 | Arness | |
| 8,096,757 | B2 | 1/2012 | Snook | |
| 8,142,137 | B2 | 3/2012 | Johnston | |
| 8,157,525 | B2 | 4/2012 | Brittingham | |
| 8,172,504 | B2 | 5/2012 | Flodman | |
| 8,206,101 | B2 | 6/2012 | Schilling | |
| 8,231,329 | B2 | 7/2012 | Benjamin | |
| 8,235,652 | B2 | 8/2012 | Broomer | |
| 8,281,604 | B2 | 10/2012 | Broomer | |
| 8,292,573 | B2 | 10/2012 | Broomer | |
| 8,353,669 | B2 * | 1/2013 | Chon | F01D 5/081 416/193 A |

(Continued)

*Primary Examiner* — Igor Kershteyn
*Assistant Examiner* — Theodore C Ribadeneyra
(74) *Attorney, Agent, or Firm* — Harvest IP Law LLP

(57) ABSTRACT

A gas turbine nozzle assembly of a gas turbine is provided. The turbine nozzle assembly may include a turbine nozzle extending from an inner diameter to an outer diameter and having an airfoil-shaped cross section having a leading edge and a trailing edge, and a pressure side and a suction side each of which extends from the leading edge to the trailing edge, wherein the turbine nozzle may include a hollow airfoil including a plurality of cavities positioned in the airfoil, an insert positioned in one or more of the plurality of cavities of the hollow airfoil, a plurality of cover plates, at least one of which is positioned at one of the inner diameter and at the outer diameter, and a plurality of impingement pans, at least one of which is positioned at one of the inner diameter and at the outer diameter.

18 Claims, 7 Drawing Sheets

(56) References Cited

U.S. PATENT DOCUMENTS

| | | | | |
|---|---|---|---|---|
| 8,403,634 | B2 | 3/2013 | Arness | |
| 8,632,297 | B2 | 1/2014 | Maldonado | |
| 8,651,799 | B2 | 2/2014 | Sewall | |
| 8,967,959 | B2 | 3/2015 | Stein | |
| 8,998,577 | B2 | 4/2015 | Gustafson | |
| 9,909,436 | B2 * | 3/2018 | Golden | F01D 9/065 |
| 10,030,537 | B2 * | 7/2018 | Dutta | F01D 9/041 |
| 10,385,727 | B2 * | 8/2019 | Dutta | F01D 9/041 |
| 2010/0124499 | A1 * | 5/2010 | Brittingham | F01D 5/189<br>416/95 |
| 2010/0129196 | A1 * | 5/2010 | Johnston | F02C 7/12<br>415/115 |
| 2017/0101892 | A1 * | 4/2017 | Dutta | F01D 9/041 |

* cited by examiner

TURBINE NOZZLE ASSEMBLY AND GAS TURBINE INCLUDING THE SAME

TECHNICAL FIELD

This application relates to a turbine nozzle assembly and more particularly to a gas turbine nozzle assembly having a cover plate capable of reducing stresses and gas turbine including the same.

BACKGROUND

Turbines are machines that obtain rotational force by impulsive force or reaction force using a flow of a compressible fluid such as steam or gas, and include a steam turbine using steam, a gas turbine using hot combustion gas, and so on.

The gas turbine includes a compressor, a combustor, and a turbine. The compressor includes an air inlet into which air is introduced, and a plurality of compressor vanes and a plurality of compressor blades which are alternately arranged in a compressor casing. The introduced air is compressed by the compressor vanes and the compressor blades while passing through the inside of the compressor.

The combustor supplies fuel to air compressed by the compressor and ignites a fuel-air mixture with an igniter to produce high-temperature and high-pressure combustion gas.

The turbine includes a plurality of turbine vanes and a plurality of turbine blades which are alternately arranged in a turbine casing. In addition, a rotor is arranged to pass through centers of the compressor, the combustor, the turbine, and an exhaust chamber.

The rotor is rotatably supported at both ends thereof by bearings. A plurality of disks is fixed to the rotor, and a plurality of blades are connected to each of the disks while a drive shaft of a generator is connected to an end of the exhaust chamber.

The gas turbine does not include a reciprocating mechanism, such as a piston, which is usually present in a typical four-stroke engine. Therefore, the gas turbine has no mutual frictional parts, such as a piston-cylinder part, thereby consuming an extremely small amount of lubricating oil and reducing an operational movement range, which results in high speed operability.

During the operation of the gas turbine, air is first compressed by a compressor and then the compressed air is mixed with fuel. Then, the fuel-air mixture is burned to produce high-temperature and high-pressure combustion gas, and the high-temperature and high-pressure combustion gas is ejected toward a turbine. The ejected combustion gas generates a rotational force by passing the turbine vanes and the turbine blades, thereby rotating the rotor.

There are various factors affecting the efficiency of the gas turbine. Recent development in the field of gas turbines has progressed in various aspects, such as improvement in combustion efficiency of the combustor, improvement in thermodynamic efficiency through the increase of a turbine inlet temperature, and improvement in aerodynamic efficiency of the compressor and the turbine.

When the high-temperature and high-pressure combustion gas is discharged to a turbine, a turbine vane exhibits a temperature variation of 1000 degrees or more throughout the regions thereof depending on whether the regions are directly exposed to the combustion gas. Excessive temperature variation may cause thermal stress attributable to heat expansion and may thus cause breakage of the turbine vane.

In order to solve these problems, there is a need to provide efficient technology for cooling the turbine vane.

SUMMARY

Aspects of one or more exemplary embodiments provide a gas turbine nozzle assembly having a cover plate which covers pockets positioned in a rear inner diameter and outer diameter of a turbine nozzle of a gas turbine, thereby reducing stresses in the rear inner and outer diameters pockets.

Additional aspects will be set forth in part in the description which follows and, in part, will become apparent from the description, or may be learned by practice of the exemplary embodiments.

According to an aspect of an exemplary embodiment, there is provided a turbine nozzle assembly including: a turbine nozzle extending from an inner diameter to an outer diameter and having an airfoil-shaped cross section having a leading edge and a trailing edge, and a pressure side and a suction side each of which extends from the leading edge to the trailing edge. Here, the turbine nozzle including: a hollow airfoil including a plurality of cavities positioned in the airfoil; an insert positioned in one or more of the plurality of cavities of the hollow airfoil; a plurality of cover plates, at least one of which is positioned at one of the inner diameter and at the outer diameter; and a plurality of impingement pans, at least one of which is positioned at one of the inner diameter and at the outer diameter.

The turbine nozzle assembly may further include cooling holes positioned at the leading edge of the airfoil.

The cooling holes may have a bilaterally symmetrical pattern.

The insert may have a pipe-type shape.

The insert may include a plurality of through holes formed in a surface thereof.

In a cross-sectional view traversing in a radial direction, the insert may have a cross-sectional shape similar to a cross-sectional shape of the cavity, resulting in a structure in which an annular space formed between an inner surface of the airfoil and an outer surface of the insert in the cavity has a uniform width.

The plurality of cavities may be defined by a plurality of ribs.

The cover plates may cover pockets positioned in a rear portion of the inner and outer diameters to reduce stresses.

The cover plate may be a recessed cover plate.

The impingement pans may include a plurality of through holes formed in a surface thereof.

According to an aspect of another exemplary embodiment, there is provided a turbine nozzle assembly including: a hollow airfoil having a leading edge and a trailing edge, sidewalls between the leading edge and the trailing edge, and inner and outer diameters disposed at opposite ends of the airfoil to support the airfoil, a plurality of cavities being defined within the airfoil and a plurality of cooling holes being defined in the leading edge of the airfoil; an insert positioned in one or more of the plurality of cavities of the hollow airfoil; a plurality of cover plates, at least one of which is positioned at one of the inner diameter and at the outer diameter; and a plurality of impingement pans, at least one of which is positioned at one of the inner diameter and at the outer diameter.

The plurality of cooling holes positioned in the leading edge of the airfoil may have a bilaterally symmetrical pattern.

The insert may have a pipe-type shape.

The insert may include a plurality of through holes formed in a surface thereof.

The cover plates may cover pockets positioned in a rear portion of the inner and outer diameters to reduce stresses.

The cover plate may be a recessed cover plate.

The impingement pans may include a plurality of through holes formed in a surface thereof.

According to an aspect of another exemplary embodiment, there is provided a gas turbine including: a compressor configured to compress air; a combustor configured to mix compressed air supplied from the compressor with fuel for combustion to generate combustion gas; and a turbine including a plurality of turbine nozzles and a plurality of turbine blades rotated by combustion gas to generate power, wherein each of the turbine nozzles extends from an inner diameter to an outer diameter and has an airfoil-shaped cross section having a leading edge and a trailing edge, and a pressure side and a suction side each of which extends from the leading edge to the trailing edge, and wherein the turbine nozzle including: a hollow airfoil including a plurality of cavities positioned in the airfoil; an insert positioned in one or more of the plurality of cavities of the hollow airfoil; a plurality of cover plates, at least one of which is positioned at one of the inner diameter and at the outer diameter; a plurality of impingement pans, at least one of which is positioned at one of the inner diameter and at the outer diameter; and a plurality of cooling holes positioned at the leading edge of the airfoil and having a bilaterally symmetrical pattern.

The insert may have a pipe-type shape and include a plurality of through holes formed in a surface thereof.

The cover plates may cover pockets positioned in a rear portion of the inner and outer diameters to reduce stresses and are recessed cover plates.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
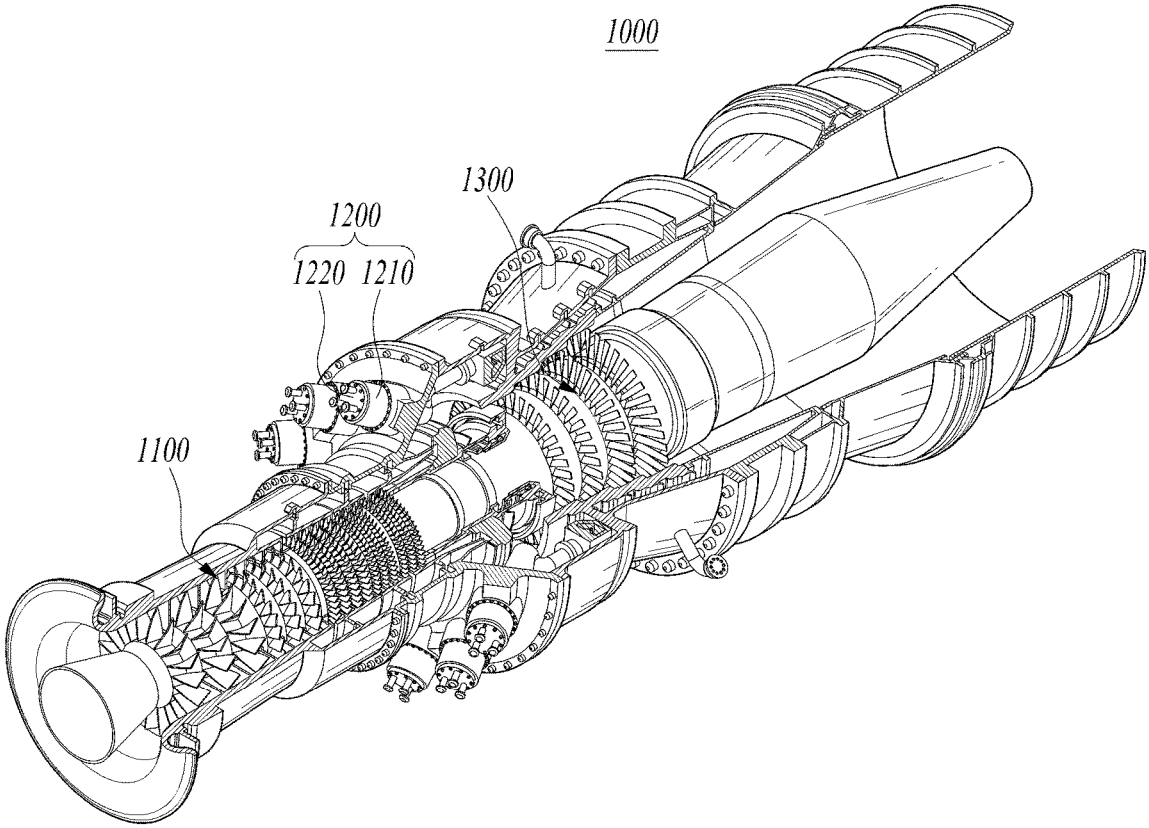
FIG. 1 is a partially cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Hereinafter, exemplary embodiments will be described in detail with reference to the accompanying drawings. Throughout the disclosure, like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
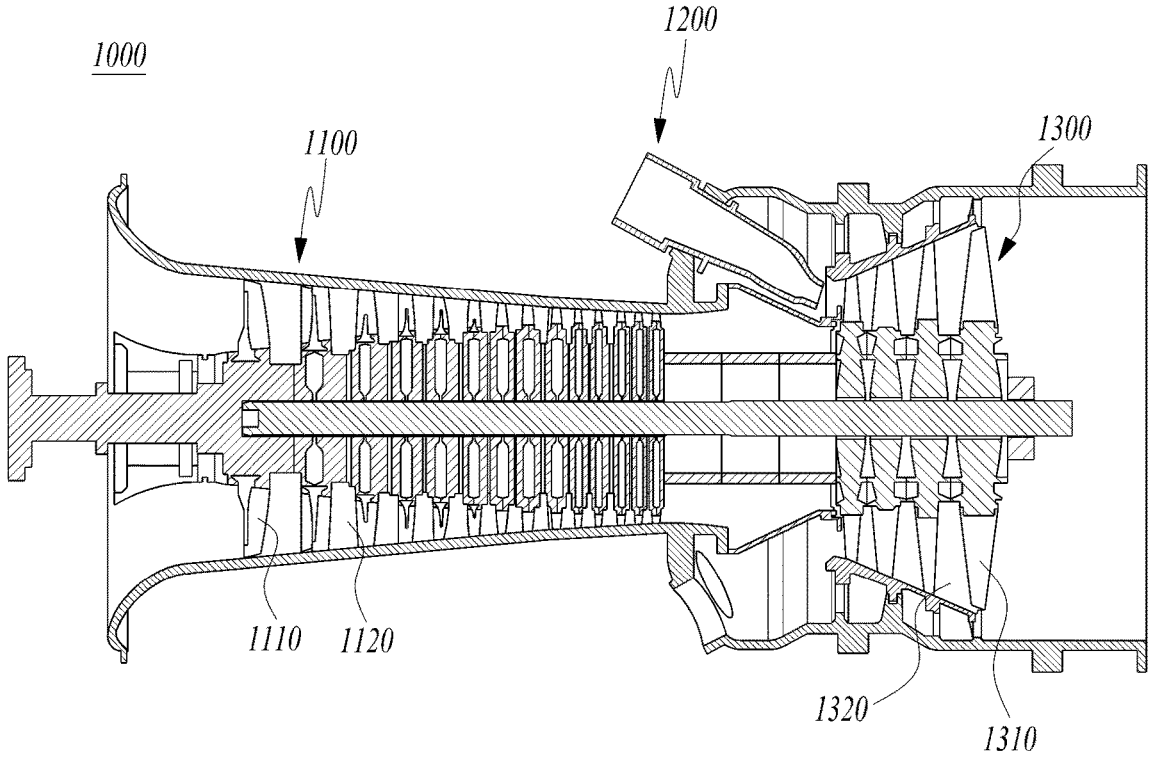
FIG. 2 is a cross-sectional view illustrating a schematic structure of the gas turbine according to the exemplary embodiment.

FIG. 1 is a partially cutaway perspective view illustrating a gas turbine according to an exemplary embodiment. FIG. 2 is a cross-sectional view illustrating a schematic structure of the gas turbine according to the exemplary embodiment.

Referring to FIGS. 1 and 2, the gas turbine 1000 may include a compressor 1100, a combustor 1200, and a turbine 1300. Based on a flow direction of gas (e.g., compressed air or combustion gas), the compressor 1100 is disposed at an upstream side of the gas turbine 1000, and the turbine 1300 is disposed at a downstream side of the gas turbine 1000. The combustor 1200 is disposed between the compressor 1100 and the turbine 1300.

The compressor 1100 includes compressor vanes 1120 and compressor rotors in a compressor housing. The turbine 1300 includes turbine vane 1320 and turbine rotors in a turbine housing. The compressor vanes 1120 and the compressor rotors are arranged in a multi-stage arrangement along the flow direction of compressed air. The turbine vanes 1320 and the turbine rotors are arranged in a multi-stage arrangement along the flow direction of combustion gas. The compressor 1100 is designed such that an internal space is gradually decreased in size from a front stage to a rear stage so that air drawn into the compressor 1100 can be compressed. On the other hand, the turbine 1300 is designed such that an internal space is gradually increased in size from a front stage to a rear stage so that combustion gas received from the combustor 1200 can expand.

A torque tube for transmitting a rotational torque generated by the turbine 1300 to the compressor 1100 is disposed between a compressor rotor that is located at the rearmost stage of the compressor 1100 and a turbine rotor that is located at the foremost stage of the turbine 1300. FIG. 2 illustrates a case in which the torque tube includes multiple torque tube disks arranged in a three-stage arrangement, but it is understood that this is only an example and other exemplary embodiments are not limited thereto. For example, the torque tube may include multiple torque tube disks arranged in an arrangement of equal to or greater than four stages or an arrangement of equal to or less than two stages.

Each of the compressor rotors includes a compressor rotor disk and a compressor blade 1110 fastened to the compressor rotor disk. That is, the compressor 1100 includes a plurality of compressor rotor disks, and respective compressor rotor disks are coupled to each other by a tie rod to prevent axial separation in an axial direction. The compressor rotor disks are arranged in the axial direction with the tie rod extending through centers of the compressor rotor disks. Adjacent compressor rotor disks are arranged such that opposing surfaces thereof are in tight contact with each other by being tightly fastened by the tie rod so that the adjacent compressor rotor disks cannot rotate relative to each other. Each of the compressor rotor disks has a plurality of compressor blades 1110 radially coupled to an outer circumferential surface thereof.

The compressor blades 1110 (also referred to as buckets) are radially coupled to an outer circumferential surface of each of the compressor rotor disks in a row. The compressor vanes 1120 (also referred to as nozzles) are provided on an inner circumferential surface of the compressor housing in an annular row in each stage, and rows of the compressor vanes 1120 are arranged between rows of the compressor blades 1110. While the compressor rotor disks rotate along with a rotation of the tie rod, the compressor vanes 1120 fixed to the housing do not rotate. The compressor vanes 1120 guide the flow of compressed air moved from front-stage compressor blades to rear-stage compressor blades.

The tie rod is disposed to pass through centers of the plurality of compressor rotor disks and turbine rotor disks. One end of the tie rod is fastened to a compressor disk located at the foremost stage of the compressor 1100, and the other end thereof is fastened in the torque tube by a fastening nut.

It is understood that the tie rod is not limited to the example illustrated in FIG. 2, and may be changed or varied according to one or more other exemplary embodiments. For example, a single tie rod may be disposed to pass through the centers of the rotor disks, a plurality of tie rods may be arranged circumferentially, or a combination thereof may be used.

Also, a deswirler (not shown) serving as a guide vane may be provided in the compressor 1100 to adjust an actual inflow angle of the fluid entering into an inlet of the combustor 1200 to a designed inflow angle.

The combustor 1200 mixes the introduced compressed air with fuel, burns a fuel-air mixture to produce high-temperature and high-pressure combustion gas with high energy, and increases the temperature of the combustion gas to a temperature at which the combustor and the turbine components are able to withstand an isobaric combustion process.

A plurality of combustors constituting the combustor 1200 of the gas turbine may be arranged in the housing in a form of a cell. Each combustor includes a burner having a fuel injection nozzle and the like, a combustor liner defining a combustion chamber, and a transition piece serving as a connector between the combustor and the turbine. The combustor 1200 may include a burner having a fuel injection nozzle 1220, a combustor liner defining a combustion chamber 1210, and a transition piece serving as a connector between the combustor and the turbine.

Here, the combustor liner provides a combustion zone in which the fuel injected through the fuel injection nozzle and the compressed air fed from the compressor are mixed and burned. The combustor liner includes a flame tube providing the combustion zone in which the fuel-and-air mixture is burned and a flow sleeve that surrounds the flame tube to provide an annular space between the flow sleeve and the flame tube. A fuel nozzle is coupled to a front end of the combustor liner, and a spark igniter plug is coupled to the flank surface of the combustor liner.

The transition piece is connected to the rear end of the combustor liner to deliver the combustion gas toward the turbine. The transition piece is configured such that the outer wall surface thereof is cooled by the compressed air supplied from the compressor. Therefore, it is possible to prevent the transition piece from being damaged.

To this end, the transition piece is provided with cooling holes through which the compressed air is blown into the transition piece. The compressed air cools the inside of the main body of the transition piece and then flows toward the combustor liner side.

Cooling air used to cool the transition piece flows through the annulus space of the combustor liner. The combustor liner is configured such that cooling air externally introduced into the annular space through the cooling holes formed in the flow sleeve impinges the outer wall of the combustor liner.

The high-temperature and high-pressure combustion gas supplied from the combustor 1200 flows into the turbine 1300 and expands while passing through the inside of the turbine 1300, thereby applying an impulsive force or reaction force to the turbine blades 1310 to generate a rotational torque. A portion of the rotational torque is transmitted to the compressor 1100 via the torque tube, and a remaining portion which is an excessive torque is used to drive a generator to produce power.

The turbine 1300 basically has a structure similar to the compressor 1100. That is, the turbine 1300 may include a plurality of turbine rotors similar to the compressor rotors, and each of the turbine rotor may include a turbine rotor disk and a turbine blade 1310 fastened to the turbine rotor disk. A plurality of turbine blades 1310 (also referred to as buckets) are radially disposed. A plurality of turbine vanes 1320 (also referred to as nozzles) are fixedly arranged on an inner circumferential surface of the turbine housing in an annular row in each stage, and rows of the turbine vanes 1320 are arranged between rows of the turbine blades 1310. The turbine vanes 1320 guide the flow direction of combustion gas passing through the turbine blades 1310.

Figure 3:
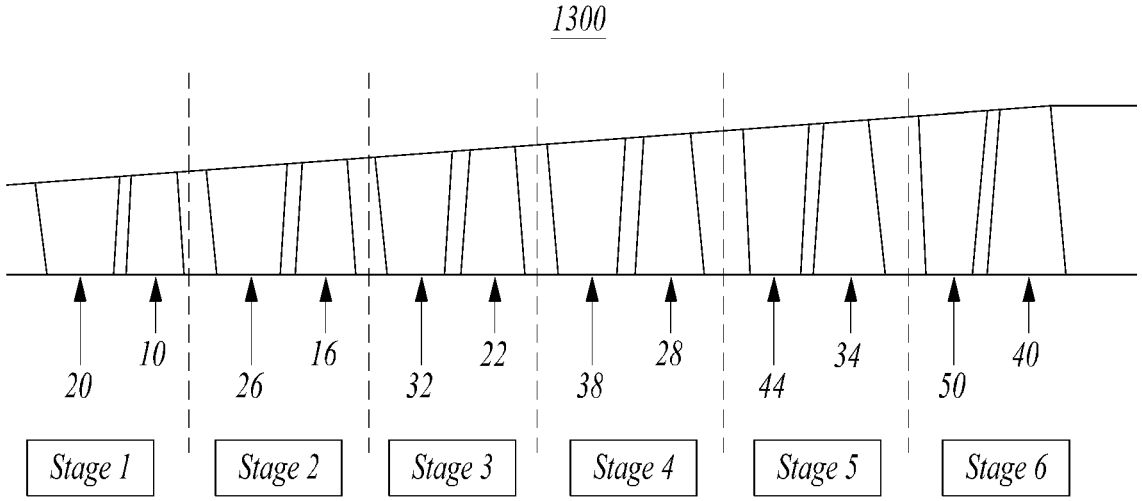
FIG. 3 is a schematic diagram of a turbine according to an exemplary embodiment.

FIG. 3 is a schematic diagram of the turbine 1300 according to an exemplary embodiment.

Referring to FIG. 3, the turbine 1300 may include a plurality of turbine stages employing a plurality of nozzles and a plurality of buckets. For example, the turbine may include a first stage with nozzle 20 and bucket 10, a second stage with nozzle 26 and bucket 16, third stage with nozzle 32 and bucket 22, fourth stage with nozzle 38 and bucket 28, fifth stage with nozzle 44 and bucket 34, and sixth stage with nozzle 50 and bucket 40. For convenience of illustration and description, FIG. 3 illustrates six exemplary stages, but it is understood that this is only an example and any number of stages may be used.

Figure 4:
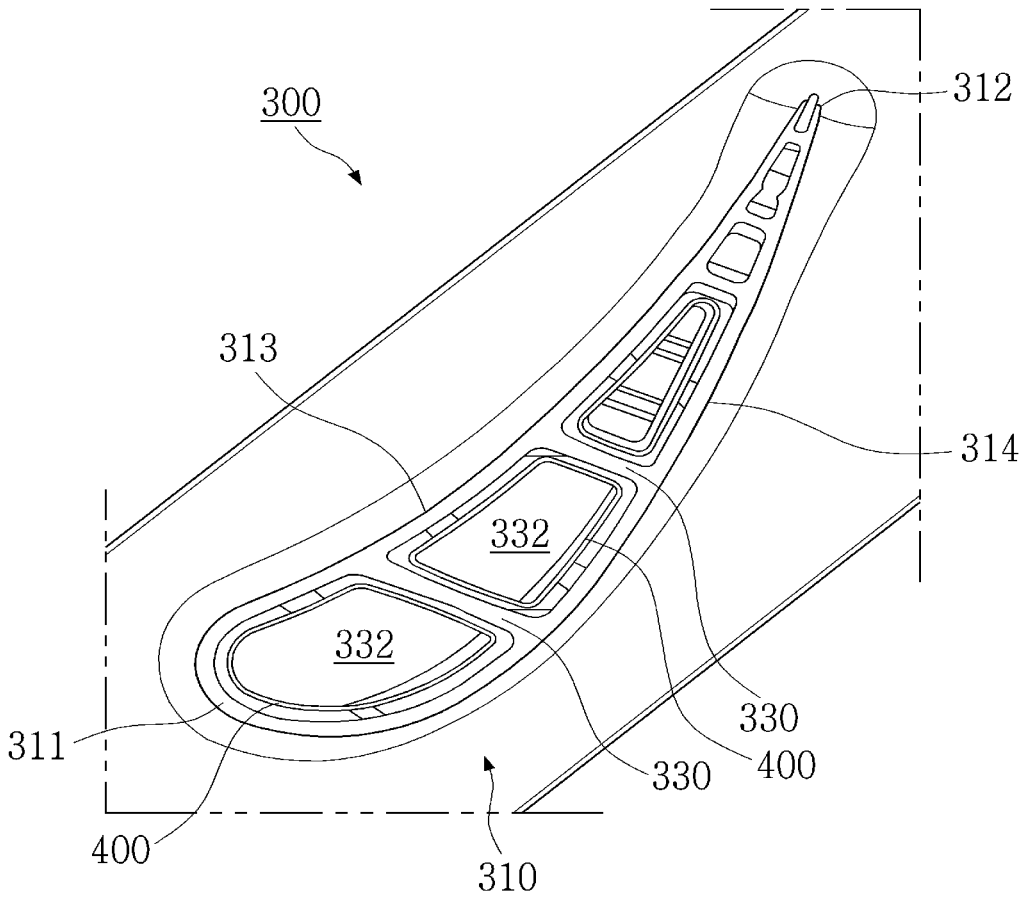
FIG. 4 is a cross-sectional view of a turbine nozzle assembly according to an exemplary embodiment.

FIG. 4 is a cross-sectional view of a turbine nozzle assembly according to an exemplary embodiment.

Referring to FIG. 4, the turbine nozzle assembly 300 includes a turbine vane airfoil 310 having an airfoil-shaped cross section having a leading edge 311, a trailing edge 312, a pressure side 313, and a suction side 314. The pressure side 313 and the suction side 314 are formed to extend from the leading edge 311 to the trailing edge 312. In the turbine vane airfoil 310, a plurality of cavities 332 are defined by a plurality of ribs 330 extending from the pressure side 313 to the suction side 314.

FIG. 4 illustrates a state in which the turbine nozzle assembly 300 includes an insert 400 inserted into the turbine vane airfoil 310. The turbine vane airfoil 310 includes the plurality of cavities 332 defined by the plurality of ribs 330 extending from the pressure side 313 to the suction side 314. The plurality of ribs 330 are alternately coupled to an inner diameter 320 and an outer diameter 330 so as to form a meandering flow path in which the flow direction of the compressed air flowing in the radial direction of the turbine vane airfoil 310 is reversed multiple times.

A cooling fluid, particularly cooling air, passing through the insert 400 is referred to as an impinging jet, and the cooling action to cool the turbine nozzle assembly 300 by contact of the impinging jet with a side wall of the turbine nozzle assembly 300 is referred to as impingement cooling. The insert 400 serves as an inner wall surface for impingement cooling in the turbine nozzle assembly 300, and is formed in the form of a pipe having a plurality of through holes formed to pass through the pipe wall. In a cross-sectional view of the turbine vane airfoil 310, viewed in a direction that transverses in the radial direction, the insert 400 has a cross-sectional shape that is similar to the cross-sectional shape of the cavity 332. An annular space formed between the inner surface of the turbine vane airfoil 310 and the outer surface of the insert 400 in the cavity 332 has a uniform width, thereby achieving a uniform collision cooling effect over the entire inner surface of the turbine vane airfoil 310.

Here, a part of the cavities formed in the turbine nozzle assembly 300 is not provided with the insert 400. For example, because the cavity 332 closest to the trailing edge 312 is narrow, the insert 400 is not provided in that cavity. That is, the exemplary embodiment should not be construed to be limited to the turbine nozzle assembly 300 in which all of the cavities 332 are provided with the inserts 400.

Figure 5:
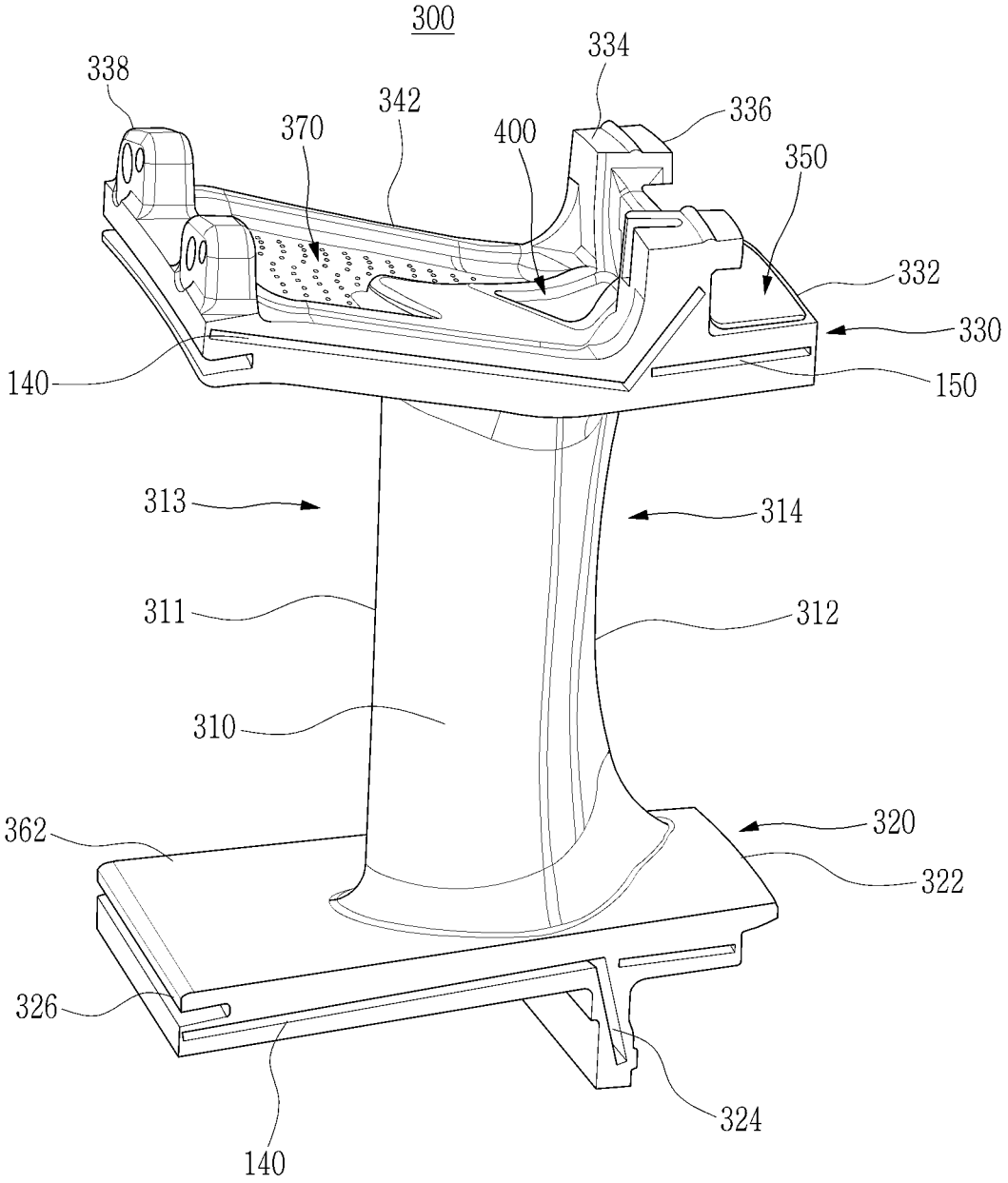
FIG. 5 is a top-down side perspective view of a turbine nozzle assembly including an airfoil according to an exemplary embodiment.
Figure 6:
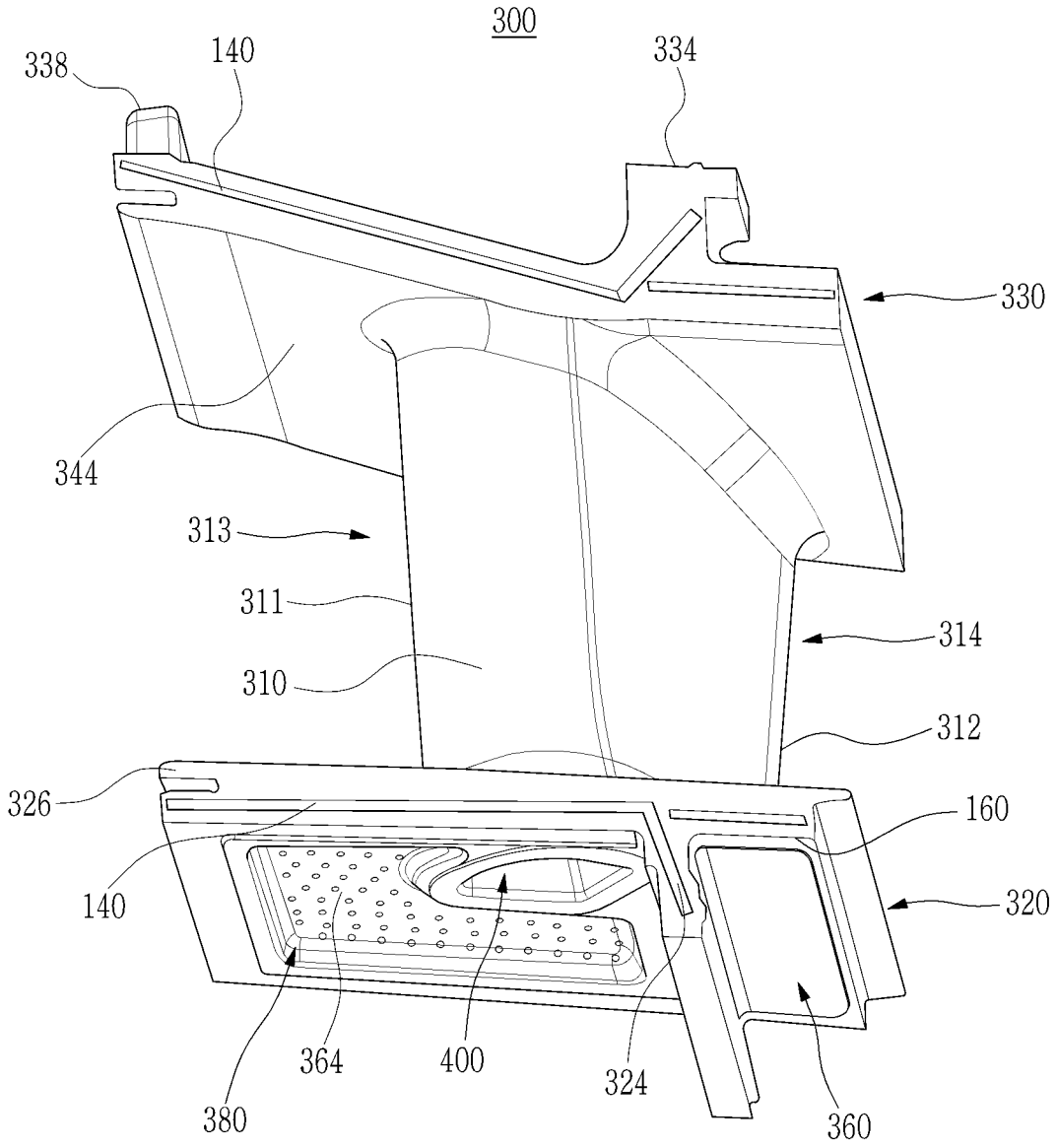
FIG. 6 is a bottom-up side perspective view of a turbine nozzle assembly including an airfoil according to an exemplary embodiment.

FIG. 5 is a top-down side perspective view of a turbine nozzle assembly including an airfoil according to an exemplary embodiment. FIG. 6 is a bottom-up side perspective view of a turbine nozzle assembly including an airfoil according to an exemplary embodiment.

Referring to FIGS. 5 and 6, the turbine nozzle assembly 300 includes a turbine vane airfoil 310 and inner and outer diameters 320 and 330, respectively. Each of the inner and outer diameters 320 and 330 is provided with a stress relief pocket 150 and a stress relief pocket 160, respectively. Further, each of the inner and outer diameters 320 and 330 is provided with cover plates 350 and 360 covering the stress relief pockets 150 and 160, respectively.

The turbine vane airfoil 310 extending from the inner diameter 320 to the outer diameter 330 includes a leading edge 311, a trailing edge 312, a pressure side 313, and a suction side 314. Here, the leading edge 311 refers to a front end colliding with fluid flowing along the turbine vane airfoil 310, and the trailing edge 312 refers to a rear end of the turbine vane airfoil 310. The pressure side 313 is subjected to pressure due to the flowing fluid.

The inner diameter 320 includes an outer surface 362, an inner surface 364, and a platform part 322. The inner diameter 320 includes at least one flange, such as an aft flange 324 that extends radially inwardly therefrom with respect to the center axis. For example, the aft flange 324 extends radially inwardly from the inner diameter 320 with respect to the radially inner surface 364 of the inner diameter 320. The inner diameter 320 further includes a forward flange 326 that extends radially inwardly therefrom. For example, the forward flange 326 extends radially outwardly from the inner surface 364.

The outer diameter 330 includes an outer surface 342, an inner surface 344, and a platform part 332. The outer diameter 330 includes at least one flange, such as an aft flange 334 that extends generally radially outwardly therefrom. For example, the aft flange 334 extends radially outwardly from the outer diameter 330 with respect to the radially outer surface 342 of the outer diameter 330. Further, at least one projection, such as projection 336 extends in an axial direction from the aft flange 334. The outer diameter 330 further includes a forward flange 338 that extends radially outwardly therefrom. For example, the forward flange 338 extends radially outwardly from the outer surface 342 of the outer diameter 330.

The inner and outer diameters 320 and 330 are positioned at opposite ends of the turbine vane airfoil 310 so as to support the turbine vane airfoil 310. The turbine nozzle assembly 300 is constructed such that the inner diameter 320 is positioned toward the rotational axis of the gas turbine and the outer diameter 330 is positioned outward of the rotational axis of the gas turbine.

Each of the platform parts 322 and 332 may have a shape of a plate having a flat surface facing the turbine vane airfoil 310. The flanges 324, 326, 334, and 338 are disposed on the outer surfaces of the platform parts 322 and 332, that is, the surfaces opposite the flat surfaces facing the turbine vane airfoil 310, and extend outward from the platform parts 322 and 332.

The turbine nozzle assembly 300 includes a stress relief pocket 150 defined within the outer surface 342 of the outer diameter 330 and a stress relief pocket 160 defined within the inner surface 364 of the inner diameter 320. In the exemplary embodiment, the stress relief pockets 150 and 160 are openings defined within the outer surface 342 of the outer diameter 330 and the inner surface 364 of the inner diameter 320, respectively. Here, material forming outer surface 342 of the outer diameter 330 is removed to form the stress relief pocket 150. For example, the stress relief pocket 150 may be formed using an electro-machining process such as electrical discharge machining. The stress relief pocket 150 may also be formed within outer surface 342 of the outer diameter 330 during a casting process or using a related art machining process. The stress relief pocket 160 is formed in substantially the same manner as the stress relief pocket 150. The stress relief pockets 150 and 160 may be formed within the outer surface 342 of the outer diameter 330 and inner surface 364 of the inner diameter 320, respectively, using any process that enables the turbine nozzle assembly 300 to operate as described herein.

For example, the stress relief pockets 150 and 160 may extend any depth into outer surface 342 of the outer diameter 330 and inner surface 364 of the inner diameter 320, respectively, that enable the stress relief pockets 150 and 160 to function as described herein. Also, it is understood that although illustrated as rectangular openings, the stress relief pockets 150 and 160 may include any shape or size that enable the stress relief pockets 150 and 160 to function as described herein. For example, a length, depth, and height of the stress relief pockets 150 and 160 may be optimized to maximize stress reduction while minimizing other impacts on the turbine nozzle assembly 300.

In the exemplary embodiment, the stress relief pocket 150 is defined within the outer diameter 330, proximate to the trailing edge 312 of the turbine vane airfoil 310. Similarly, the stress relief pocket 160 is defined within the inner diameter 320, proximate to the trailing edge 312 of the turbine vane airfoil 310. That is, the stress relief pocket 150 is defined outward from a tip of the turbine vane airfoil 310 and the stress relief pocket 160 is defined inward from a root of the turbine vane airfoil 310.

The trailing edge 312 is thinner than the leading edge 311. The different amount of material present along the trailing edge 312 compared to the leading edge 311 causes temperature changes to affect the trailing edge 312 differently than the leading edge 311. The temperature changes that occur during engine startup and engine shutdown may cause stress on the turbine nozzle assembly 300. The stress may include compressive stress and/or tensile stress. For example, during engine startup, as high-temperature and high-pressure combustion gas flows past the turbine vane airfoil 310 that was previously at an ambient temperature, the trailing edge 312 heats faster than the leading edge 311. This heating causes a greater expansion of the trailing edge 312 and therefore a greater compression occurs between the inner and outer diameters 320 and 330 at the trailing edge 312 than between the inner and outer diameters 320 and 330 at the leading edge 311. Conversely, during engine shutdown, the trailing edge 312 cools more rapidly than the leading edge 311. This cooling causes a greater contraction of the trailing edge 312 and therefore a greater tension at the trailing edge 312 than at the leading edge 311. The stress relief pockets 150 and 160 facilitate increasing a flexibility of inner and outer diameters 320 and 330 at the trailing edge 312, and thereby facilitate reducing a magnitude of both compressive and tensile portions of total stress.

As shown in FIGS. 5 and 6, the cover plate 360 may be located adjacent the inner surface 364 of the inner diameter 320 and the cover plate 350 may be located adjacent outer surface 342 of the outer diameter 330 to cover the stress relief pockets 160 and 150, respectively. For example, the cover plates 350 and 360 may be a recessed cover plate. Here, the turbine nozzle assembly 300 including the turbine vane airfoil 310 according to the exemplary embodiment may solve the weld cracking problem in the field by covering the stress relief pockets 150 and 160 by the cover having the recessed cover plates 350 and 360.

Referring to FIGS. 5 and 6, the turbine nozzle assembly 300 includes an impingement pan 370 that is defined in outer surface 342 of the outer diameter 330 and an impingement pan 380 that is defined in inner surface 364 of the inner diameter 320. For example, impingement cooling air passes through the impingement pans 370 and 380 to cool the outer surface 342 of the outer diameter 330 and the inner surface 364 of the inner diameter 320, respectively. Each of the outer diameter 330 and the inner diameter 320 includes seal slots 140 which extend circumferentially into the outer and inner diameter surfaces 342 and 364, respectively. Seal slots 140 are sized to receive seals which prevent cooling air from leaking into flow path.

The impingement pans 370 and 380 may be thin sheet metal suitably brazed to the exposed surfaces of the outer diameter 330 and the inner diameter 320 to locally cover the platform parts. The impingement pans 370 and 380 may include impingement holes to provide impingement cooling of the outer diameter 330 and the inner diameter 320.

Figure 7:
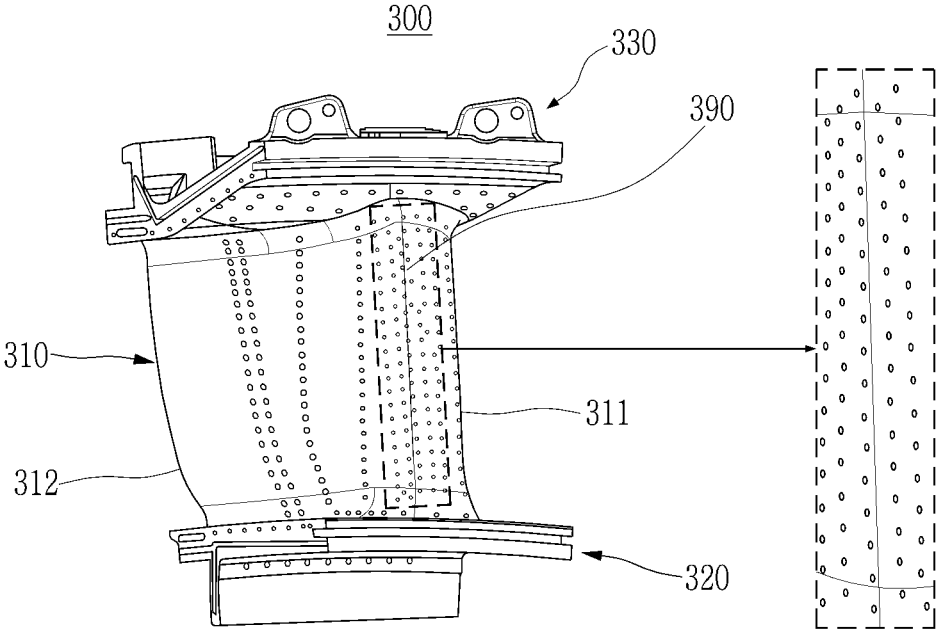
FIG. 7 is a forward perspective view of a turbine nozzle assembly including cooling holes according to an exemplary embodiment.

FIG. 7 is a forward perspective view of a turbine vane including cooling holes according to an exemplary embodiment.

Referring to FIG. 7, an exemplary embodiment of a turbine nozzle assembly 300 includes a turbine vane airfoil 310 extending from an inner diameter 320 to an outer diameter 330. The turbine vane airfoil 310 includes a leading edge 311 and a trailing edge 312. The turbine vane airfoil 310 further includes a plurality of cooling holes 390. In general, the cooling holes may be grouped or arranged in a pattern. For example, the cooling holes 390 may be arranged in rows in which the cooling holes 390 are radially spaced along an axial position. As illustrated in FIG. 7, the cooling holes 390 may be positioned at the leading edge 311 of the turbine vane airfoil 310 and have a bilaterally symmetrical pattern. That is, the turbine vane airfoil 310 includes cooling holes 390 radially distributed along the leading edge 311 between the outer diameter 330 and the inner diameter 320.

FIG. 7 illustrates an exemplary radial row or column of the cooling holes 390 in radial section along the leading edge 311 of the turbine vane airfoil 310. The cooling holes 390 may be inclined radially inwardly toward the surrounding inner diameter 320 to discharge spent cooling air from inside the hollow turbine vane airfoil 310 and outwardly through sidewalls toward the inner diameter 320. Also, the cooling holes 390 may be inclined radially outwardly toward the surrounding outer diameter 330 to discharge another portion of the spent cooling air outwardly through sidewalls toward the outer diameter 330. The initial or fundamental purpose of the inclined cooling holes 390 is for providing both internal convection cooling of the turbine vane airfoil sidewalls in which they are located as well as providing external film cooling.

For example, FIG. 7 illustrates the integral outer and inner diameters 330 and 320 which extend or cantilever laterally outwardly from the opposite ends of the turbine vane airfoil 310 itself in an exemplary singlet casting manufacture thereof. Accordingly, the outer and inner diameters 330 and 320 themselves interfere with the drilling of the cooling holes 390 due to their overhang.

The cooling holes 390 may be manufactured by any known process, such as by laser drilling or by electrical discharge machining (EDM). Near the midspan of the turbine vane airfoil 310, the outer and inner diameters 330 and 320 provide minimal overhang obstruction and permit the corresponding cooling holes 390 to be drilled relatively shallow with preferred angle of inclination.

In the exemplary embodiment illustrated in FIG. 7, the patterns of the cooling holes 390 include a number of radial rows spaced laterally or circumferentially apart from each other. The cooling holes 390 are arranged along the leading edge 311 with a bilateral symmetrical pattern. For example, the cross-section of the passageway of the cooling holes 390 may be circular or oval in shape. However, it is understood that the cooling holes 390 may be arranged in several patterns or arrangements depending on the application.

Accordingly, the cooling holes 390 not only effectively cool the leading edge 311 of the turbine vane airfoil 310 against the heat influx from the incident combustion gas, but significantly alter the radial temperature profile of the combustion gas near both the inner diameter 320 as well as the outer diameter 330.

The simple modification of the turbine vane cooling at the leading edge 311 permits corresponding modifications in the downstream flow path components for reducing their cooling air requirements, and correspondingly further increasing engine efficiency. Further, by reducing the combustion gas temperature near the inner and outer diameters of the turbine vane, the durability thereof may be enhanced for maximizing the useful life thereof, while also increasing engine performance.

While one or more exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense only and not to limit the scope of the claims, and many alternatives, modifications, and variations will be apparent to those skilled in the art.

What is claimed is:

1. A turbine nozzle assembly of a turbine comprising:

a turbine nozzle extending from an inner diameter to an outer diameter and having an airfoil-shaped cross section having a leading edge and a trailing edge, and a pressure side and a suction side each of which extends from the leading edge to the trailing edge, wherein the turbine nozzle comprises:

a hollow airfoil including a plurality of cavities positioned in the airfoil;

an insert positioned in one or more of the plurality of cavities of the hollow airfoil;

a plurality of cover plates, at least one of which is positioned at the inner diameter and at least one of which is positioned at the outer diameter; and a plurality of impingement pans, at least one of which is positioned at the inner diameter and at least one of which is positioned at the outer diameter, wherein the cover plate of the inner diameter covers a first pocket, and the cover plate of the outer diameter covers a second pocket, wherein the first pocket arranged to form a first recessed area within the inner diameter at the trailing edge portion of the airfoil includes a first opening facing radially inward relative to a central axis of the turbine, and the second pocket arranged to form a second recessed area within the outer diameter at the trailing edge portion of the airfoil includes a second opening facing radially outward relative to the central axis of the turbine.

2. The turbine nozzle assembly according to claim 1, further comprising cooling holes positioned at the leading edge of the airfoil.

3. The turbine nozzle assembly according to claim 2, wherein the cooling holes have a bilaterally symmetrical pattern.

4. The turbine nozzle assembly according to claim 1, wherein the insert has a pipe-type shape.

5. The turbine nozzle assembly according to claim 4, wherein the inserts include a plurality of through holes formed in a surface thereof.

6. The turbine nozzle assembly according to claim 4, wherein the insert has a cross-sectional shape similar to a cross-sectional shape of the cavity in a radially transverse direction, resulting in a structure in which an annular space formed between an inner surface of the airfoil and an outer surface of the insert in the cavity has a uniform width.

7. The turbine nozzle assembly according to claim 1, wherein the plurality of cavities is defined by a plurality of ribs.

8. The turbine nozzle assembly according to claim 1, wherein the plurality of cover plates are recessed cover plates.

9. The turbine nozzle assembly according to claim 1, wherein the impingement pans include a plurality of through holes formed in a surface thereof.

10. A turbine nozzle assembly of a turbine comprising:

a hollow airfoil having a leading edge, a trailing edge, sidewalls between the leading edge and the trailing edge, and inner and outer diameters disposed at opposite ends of the airfoil to support the airfoil, a plurality of cavities being defined within the airfoil and a plurality of cooling holes being defined in the leading edge of the airfoil;

an insert positioned in one or more of the plurality of cavities of the hollow airfoil;

a plurality of cover plates, at least one of which is positioned at the inner diameter and at least one of which is positioned at the outer diameter; and a plurality of impingement pans, at least one of which is positioned at the inner diameter and at least one of which is positioned at the outer diameter, wherein the cover plate of the inner diameter covers a first pocket, and the cover plate of the outer diameter covers a second pocket, wherein the first pocket arranged to form a first recessed area within the inner diameter at the trailing edge portion of the airfoil includes a first opening facing radially inward relative to a central axis of the turbine, and the second pocket arranged to form a second recessed area within the outer diameter at the trailing edge portion of the airfoil includes a second opening facing radially outward relative to the central axis of the turbine.

11. The turbine nozzle assembly according to claim 10, wherein the plurality of cooling holes positioned in the leading edge of the airfoil have a bilaterally symmetrical pattern.

12. The turbine nozzle assembly according to claim 10, wherein the insert has a pipe-type shape.

13. The turbine nozzle assembly according to claim 12, wherein the insert includes a plurality of through holes formed in a surface thereof.

14. The turbine nozzle assembly according to claim 10, wherein the cover plate is a recessed cover plate.

15. The turbine nozzle assembly according to claim 10, wherein the impingement pans include a plurality of through holes formed in a surface thereof.

16. A gas turbine comprising:

a compressor configured to compress air;

a combustor configured to mix compressed air supplied from the compressor with fuel for combustion to generate combustion gas; and a turbine comprising a plurality of turbine nozzles and a plurality of turbine blades rotated by the combustion gas to generate power, wherein each of the turbine nozzles extends from an inner diameter to an outer diameter and has an airfoil-shaped cross section having a leading edge and a trailing edge, and a pressure side and a suction side each of which extends from the leading edge to the trailing edge, and wherein the turbine nozzle comprises:

a hollow airfoil including a plurality of cavities positioned in the airfoil;

an insert positioned in one or more of the plurality of cavities of the hollow airfoil;

a plurality of cover plates, at least one of which is positioned at the inner diameter and at least one of which is positioned at the outer diameter;

a plurality of impingement pans, at least one of which is positioned at the inner diameter and at least one of which is positioned at the outer diameter; and a plurality of cooling holes positioned at the leading edge of the airfoil and having a bilaterally symmetrical pattern, wherein the cover plate of the inner diameter covers a first pocket, and the cover plate of the outer diameter covers a second pocket, wherein the first pocket arranged to form a first recessed area within the inner diameter at the trailing edge portion of the airfoil includes a first opening facing radially inward relative to a central axis of the gas turbine, and the second pocket arranged to form a second recessed area within the outer diameter at the trailing edge portion of the airfoil includes a second opening facing radially outward relative to the central axis of the gas turbine.

17. The gas turbine according to claim 16, wherein the insert has a pipe-type shape and includes a plurality of through holes formed in a surface thereof.

18. The gas turbine according to claim 16, wherein the plurality of cover plates are recessed cover plates.

* * * * *